United States Patent [19]

Tamura

[11] Patent Number: 4,658,961

[45] Date of Patent: Apr. 21, 1987

[54] FOLDABLE CASE BLANK

[75] Inventor: Takeo Tamura, Tokyo, Japan

[73] Assignee: Tanabe Machinery Co., Ltd., Tokyo, Japan

[21] Appl. No.: 787,378

[22] Filed: Oct. 15, 1985

[51] Int. Cl.[4] ..... B65D 21/02; B65D 5/44

[52] U.S. Cl. ..... 206/509; 229/161; 229/915

[58] Field of Search ..... 206/509; 229/161, DIG. 11, 229/915, 916, 917, 918, 919

[56] References Cited

U.S. PATENT DOCUMENTS

| | | | |
|---|---|---|---|
| 2,901,155 | 8/1959 | Vines | 229/16 C |
| 2,903,176 | 9/1959 | Crane | 229/DIG. 11 |
| 2,907,510 | 10/1959 | Vines | 229/161 |
| 3,006,524 | 10/1961 | Todd | 229/161 |

*Primary Examiner*—George E. Lowrance

*Attorney, Agent, or Firm*—Wenderoth, Lind & Ponack

[57] ABSTRACT

A foldable case blank having first, second, third and fourth portions continuously connected through longitudinal fold lines, these portions being formed as upper, bottom, front and rear portions of a case, respectively, when the blank is fabricated as a case and side pieces attached through transverse fold lines of these first through fourth portions on both side ends thereof. The first, i.e. upper, portion is provided with shaping portions which are defined by longitudinal cut lines, transverse foldable lines and a central cut line so that the shaping portions reinforce the side portions of a fabricated case when the shaping portions are folded inwardly of the case. The shaping portions are provided with projections along the central cut line so that the projections are engaged with engaging holes formed on the bottom portion of the case when the case blank is fabricated. The upper portion is further provided with tongued pieces which are engageable with the engaging holes of the bottom portion when one case, thus fabricated, is stacked on another fabricated case.

4 Claims, 10 Drawing Figures

FOLDABLE CASE BLANK

BACKGROUND OF THE INVENTION

This invention relates to a foldable case blank provided with framed portions at the peripheral edges of an upper surface of a case when the case blank is fabricated by a case making machine.

FIG. 1 shows a conventional foldable case blank A1. Terms used hereinafter for designating portions of the case blank A1 are those of the respective positions constituting a case when the case blank is fabricated as a case. In FIG. 1, an upper plate or board 1, a bottom plate 2, and front and rear plates 3 and 4 are connected in series through longitudinal foldable lines 5, 6 and 7 so that these plates face respectively when the case blank A1 is folded along the foldable lines 5, 6 and 7 to form a substantially rectangular parallelepiped case. A connecting piece 8 is further connected to the upper edge, as seen in FIG. 1, of the front plate 3 through a longitudinal foldable line 9, and connecting pieces 10 through 17 are also connected to both sides of the upper, bottom, front and rear plates 1, 2, 3 and 4 through transverse foldable lines 18 through 25 for forming side plates when the case blank A1 is fabricated as a case, to close both longitudinal side openings of the case. The side plate pieces 10, 11, 14 and 15 connected to both side edges of the upper and bottom plates 1 and 2 have substantially the same configuration, and the side plate pieces 12, 13, 16 and 17 connected to the front and rear plates 3 and 4 have also substantially the same configuration, respectively. Furthermore, connecting pieces 27, 28, 29 and 30 are connected to the side plate pieces 10, 11, 14 and 15 at the corner portions thereof on the sides near the side plate pieces 12, 13, 6 and 17, respectively. These connecting pieces 27, 28, 29 and 30 are constructed to be foldable along foldable lines 31, 32, 33 and 34 which extend at angles of 45° with respect to the foldable lines 18, 19, 22 and 23, respectively, and these connecting pieces 27, 28, 29 and 30 are bonded to the corresponding side plate constituting pieces 12, 13, 16 and 17 when the case blank A1 is fabricated. On the central portion of the upper plate 1 is a take-out hole 26 through which an article can be taken out when the case is made.

The case blank A1 can be automatically folded by using an automatic case making machine, not shown, of the type generally used in the manner described hereinbelow.

The case blank A1 is at first folded along the foldable lines 5, 6, 7 and 9, 18 through 25, and 31 through 34, and paste is then applied to the connecting pieces 27 through 30 and 8 to be bonded to the outer surfaces of the side plate pieces 12, 13, 16 and 17, and the connecting piece 8, and to the inner surfaces of the connecting pieces 27, 28, 29 and 30 as well as the end portion of the inner surface of the bottom plate 2, thus obtaining a folded case A2 such as shown in FIG. 2.

When the folded case A2 is actually fabricated, the folded case A2 has forces applied in the directions shown by solid arrows in FIGS. 2 and 3, i.e. along the diagonal edges 5 and 7, thus fabricating a rectangular parallelepiped case A3 as shown in FIG. 3.

With the case A3 thus fabricated, the case A3 is provided with pressure resisting characteristics sufficient to resist against the force or pressure from the solid-arrowed directions on the foldable lines 5 and 7, but insufficient to resist the force or pressure from the dot-arrowed directions acting on the diagonal lines 6 and 9. In a certain case, the side plate constituting pieces 10 through 17 may be folded inwardly of the case A3 along the foldable lines 31 through 34 by a relatively weak force or pressure applied thereon.

Accordingly, in a case, for example, where fruit is accommodated in the case A3, if any force is applied from the direction of the line 6 or a plurality of such cases are stacked, the cases may be deformed thereby damaging the fruit. Furthermore, in a case where a plurality of cases A3 are stacked, the cases A3 may be extremely deformed and shifted with each other or has adversely fall down.

SUMMARY OF THE INVENTION

An object of this invention is to eliminate defects or problems included in the conventional foldable case blank and to provide an improved foldable case blank capable of providing an increase in strength of the side plates when the case blank is fabricated.

Another object of this invention is to provide an improved foldable case blank capable of obviating the deformation or falling-down of the cases when a plurality of fabricated cases are stacked.

These and other objects are attained by the foldable case blank, according to this invention, which comprises first, second, third and fourth plates which are connected continuously in series through longitudinal foldable lines and which constitute upper, bottom, front and rear plates, respectively, when the case blank is fabricated, a connecting piece attached to the third plate through a longitudinal foldable line, and side plate pieces attached through transverse foldable lines to both side ends of the first, second, third and fourth plates for closing both side openings of a case when the blank is fabricated as a case. With the foldable case blank described above, the first plate is provided with a pair of shaping plates which are defined by cut lines extending near and along the longitudinal foldable lines of the first plate, a pair of paired foldable lines extending near and along the transverse foldable lines of the first plate, and a central cut line extending substantially parallel to the central portion of the paired foldable lines, the shaping plate being provided with engaging pieces formed at the central cut line so as to project outwardly from the central cut line, and the second plate being provided with engaging holes at positions along the transverse foldable lines of the second plate to be engaged with the engaging pieces of the shaping plates, respectively, when the case blank is fabricated and the shaping plates are folded inwardly of the fabricated case.

Furthermore, according to the foldable case blank of this invention, the first plate is further provided with tongued pieces which are formed along both transverse foldable lines of the first plate and project upwardly when the side plate pieces attached to both side ends of the first plate are folded inwardly, the tongued pieces being positioned so that the tongued pieces when in a projecting state of one fabricated case are engaged with engaging holes of the bottom plate of another fabricated case stacked on the former mentioned fabricated case.

DESCRIPTION OF THE PREFERRED EMBODIMENTS

Figure 1:
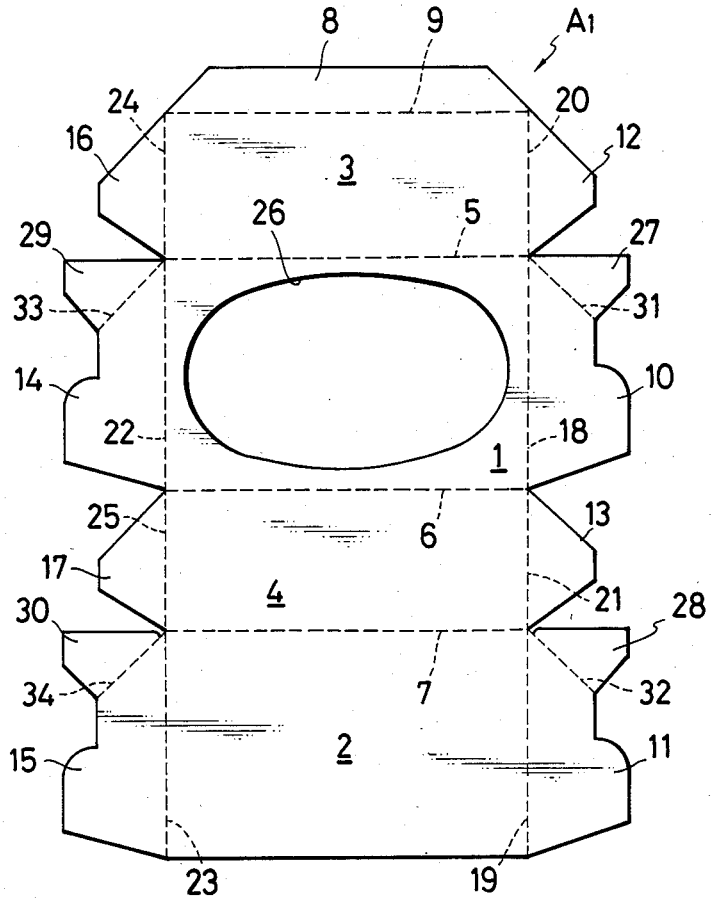
FIG. 1 PRIOR ART
FIG. 1 is a plan view of a conventional case blank.
Figure 2:
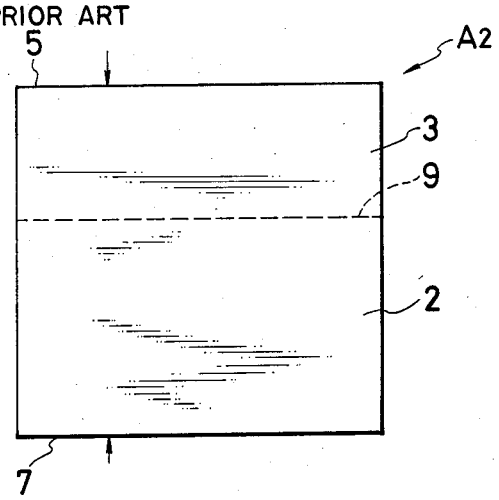
FIG. 2 PRIOR ART
FIG. 2 shows a folded case blank of FIG. 1.
Figure 3:
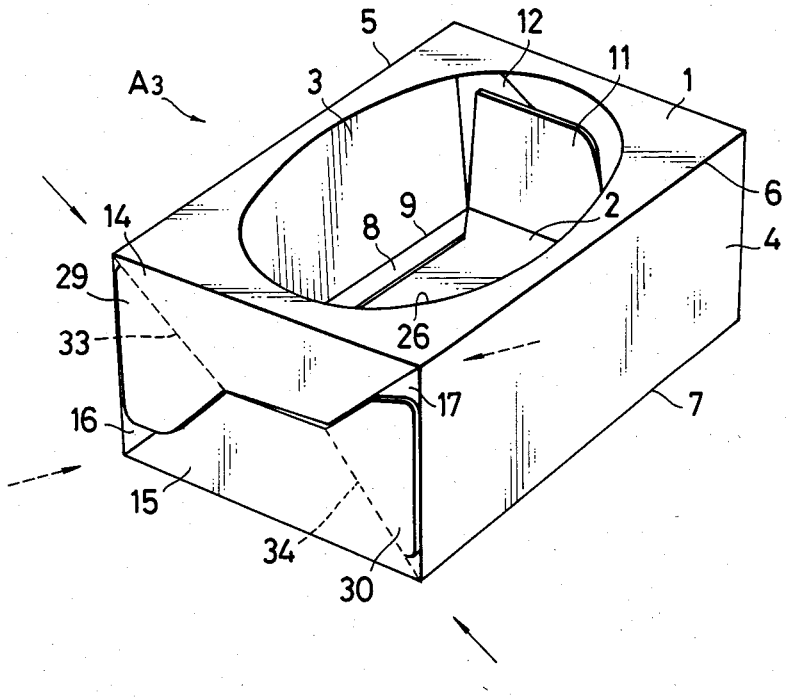
FIG. 3 PRIOR ART
FIG. 3 shows a perspective view of a case fabricated from the folded case shown in FIG. 2.
Figure 4:
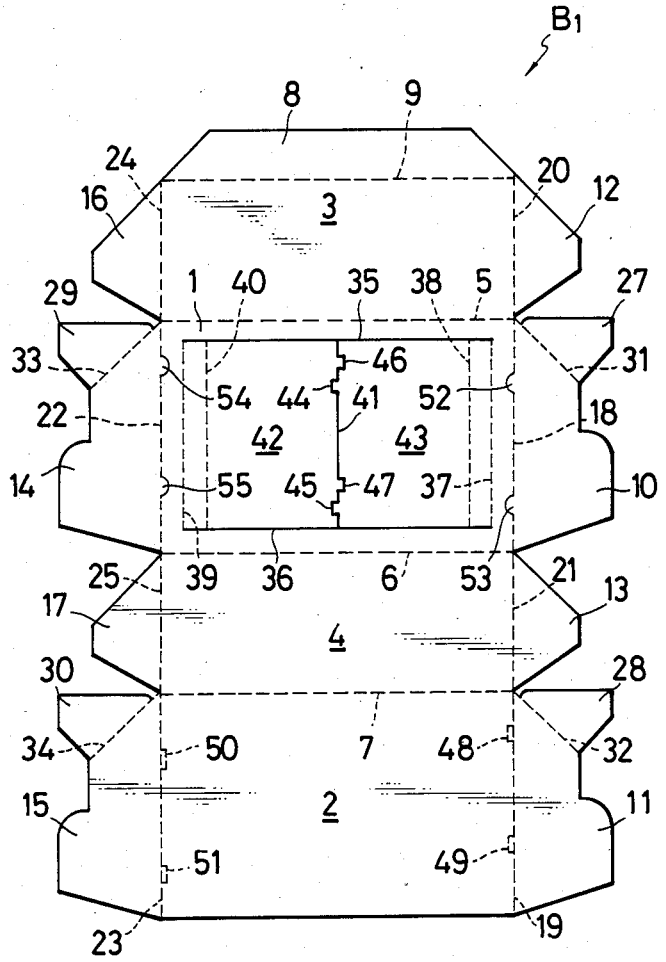
FIG. 4 is a plan view of a case blank according to this invention.

FIG. 4 shows a case blank B1 according to this invention in which like reference numerals correspond to those shown in FIGS. 1 through 3, and particularly, the members or pieces as shown in FIGS. 1 through 3 are substantially the same as those shown in FIG. 4 except for the upper plate 1 and the bottom plate 2.

Figure 6:
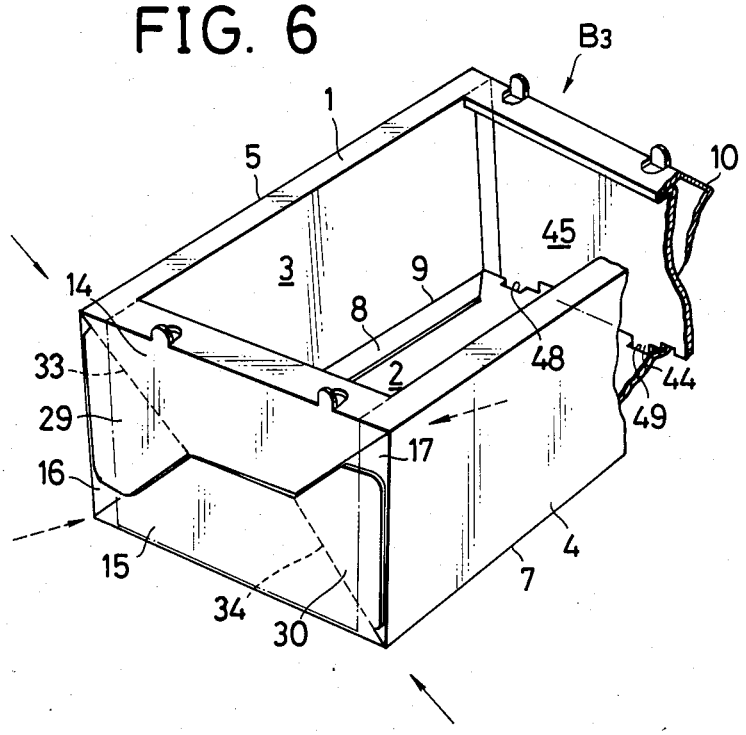
FIG. 6 is a perspective view of the case, partially cut away, fabricated in accordance with the steps shown in FIGS. 5A through 5E.

As shown in FIG. 4, according to this invention, on the upper plate 1 are formed cut lines 35 and 36 near the longitudinal fold lines 5 and 6 and parallel thereto, and a pair of paired parallel foldable lines 37, 38 and 39, 40 near the transverse foldable lines 18 and 22 and parallel thereto, respectively. A cut line 41 is further provided on the upper plate 1 between the cut lines 35 and 36 at substantially the central portion of the upper plate between the fold lines 37(38) and 39(40) substantially parallel thereto to form a pair of shaping or reinforcing plates 42 and 43. It is desirable to form the width between the foldable lines 37(39) and 38(40) so as to be equal to the width between the foldable lines 37(39) and 18(22). The central cut line 41 extends at two portions towards the foldable line 39(40) so as to form a pair of engaging pieces 44 and 45, and also extends at two portions towards the foldable line 37(38) so as to form a pair of engaging pieces 46 and 47. In intimate relation to these engaging pieces, the bottom plate 2 is provided with engaging holes 50, 51 and 48, 49 along the transverse foldable lines 23 and 19 so that the engaging pieces 44 through 47 are engaged with the corresponding engaging holes 48 through 51 when the shaping plates 42 and 43 are folded inwardly of the upper plate 1 along the foldable lines 37 and 39 so as to be folded along the inner walls of the side plate pieces 10 through 17 when the case blank B1 has been fabricated. Thus, a take-in (or take-out) opening for the case B3 is formed as shown in FIG. 6.

A pair of paired tongue-shaped connecting pieces 52, 53 and 54, 55 are further formed on the upper plate 1 along the transverse fold lines 18 and 22 respectively, so that these tongued pieces 52 through 55 extend upwardly from the upper plate 1 when the side plate pieces 10 and 14 are folded downwardly along the fold lines 18 and 22. The tongued pieces 52 through 55 of one case engage with the engaging holes 48 through 51 of the bottom plate 2, respectively, of another case when these cases are stacked.

The case making method of the case blank B1 by a case making machine, not shown, will be described hereunder in conjunction with FIGS. 5A through 5E.

The side plate pieces 12, 16, 13 and 17 for the front and rear plates 3 and 4 are first folded inwardly along the transverse fold lines 20, 21, 24 and 25 of the case blank B1, and then, the side plate pieces 10, 11, 14 and 15 for the upper and bottom plates 1 and 2 are folded inwardly along the transverse foldable lines 18, 19, 22, and 23. At substantially the same time, the connecting pieces 27, 28 and 29, 30 of the side plate pieces 10, 11 and 14, 15 are folded outwardly along the oblique foldable lines 31 through 34, respectively.

Paste 56 is applied on the rear surface of the connecting piece 8 and the front surface of the connecting pieces 27 through 30, and thereafter, the bottom plate 2 and the front plate 3 are folded along the longitudinal foldable lines 7 and 5 respectively, to thereby insert the connecting piece 8 into the space between the folded bottom plate 2 and the side plate consisting pieces 11 and 15. In this state, the case blank is pressed and dried to obtain a folded case B2 as shown in FIG. 5E.

Figure 5B:
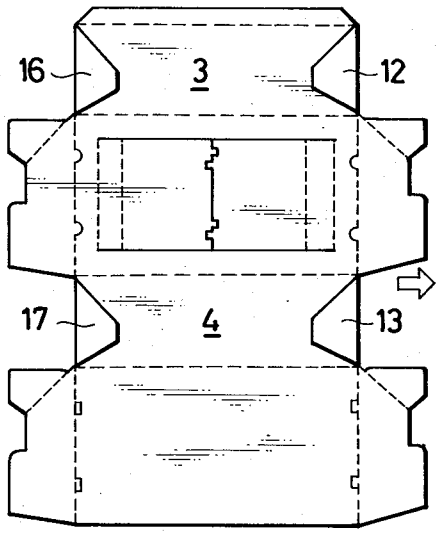
FIGS. 5A through 5D show the case blank of FIG. 4 and the steps in which it is to be folded or fabricated.
Figure 5A:
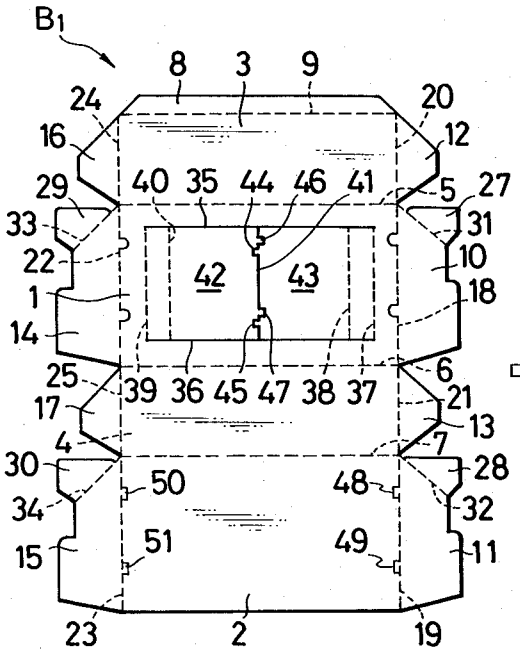
Figures 5C, 5D:
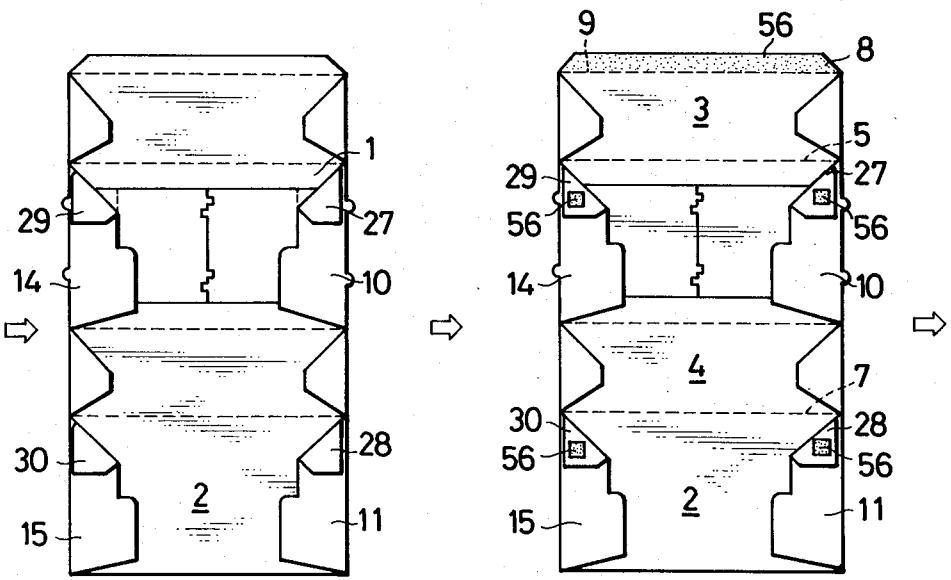
Figure 5E:
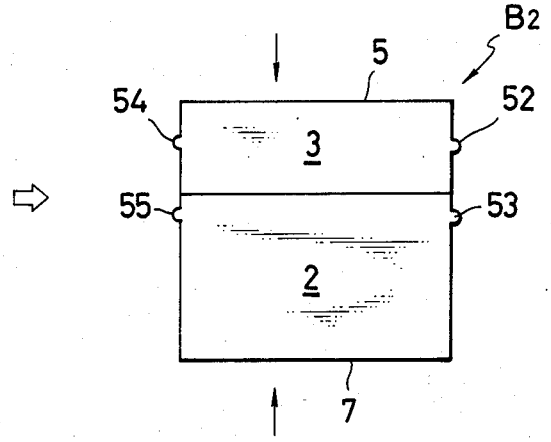
FIG. 5E shows a case folded in accordance with the steps shown in FIGS. 5A through 5D.

The fabrication of the folded case blank B2 will be performed by applying a force in the direction as shown by solid arrows in FIG. 5E and FIG. 6 on diagonally positioned foldable edges, i.e. lines 5 and 7 to form a rectangular parallelepiped case. After fabricating the rectangular parallelepiped case, the shaping plates 42 and 43 are folded inwardly along the foldable lines 37 through 40 so as to directly contact the inner walls of the upper plate 1 and the side plate pieces 10 through 17 and to place the engaging pieces 44 through 47 with the corresponding engaging holes 48 through 51, respectively, thereby to obtain a fabricated case B3 provided with the reinforced side plates.

When it is required to stack the thus fabricated cases B3, two respective cases are stacked so that the tongued pieces 52 through 55 projecting upwardly of the lower case B3 are engaged with the engaging holes 48 through 51 formed on the bottom plate 2 of the upper case B3 thereby to firmly settle the upper case B3 on the lower case B3. In thus manner, a plurality of cases B3 can be stacked without being deformed or without falling down.

As described hereinbefore, the foldable case blank of this invention can be automatically fabricated easily by a usual case making machine in mass-production. In addition, when the case is fabricated, reinforcing and shaping plates formed on the upper plates of the case can be folded inwardly of the case so as to reinforce the frame portion of the upper plate and the inner walls of the side plates of the case, so that the cases will not deform or fall down when the fabricated cases are stacked or when if any force or pressure is applied on any portion of the case. Furthermore, when a plurality of the cases are stacked, since the tongued pieces projecting from the upper plate of the lower case are engaged with the holes formed on the bottom plate of the case stacked upwardly case, the deformation or shifting of the stacked cases can be prevented and the materials contained in the cases can be protected from being damaged.

What is claimed is:

1. A foldable case blank for forming a box-like case, said blank comprising:

a first plate corresponding to a top wall of said case when said blank is folded;

a second plate corresponding to a bottom wall of said case when said blank is folded;

a third plate corresponding to a front wall of said case when said blank is folded, said third plate integral with said first plate and extending from an end thereof at a first longitudinal fold line along which said blank is folded to form said case;

a fourth plate corresponding to a rear wall of said case opposed to said front wall when said blank is folded, said fourth plate integral with and extending between the other end of said first plate at a second longitudinal fold line and an end of said second plate at a third longitudinal fold line along which said blank is folded for forming said case;

a connecting piece extending from said third plate at a fourth longitudinal fold line and at the end thereof opposite the end from which third plate extends from said first plate, said first, second, third and fourth longitudinal fold lines extending substantially parallel to one another, and said connecting piece being attachable to said second plate when said foldable blank is folded along said first, second, third and fourth longitudinal fold lines when forming said case;

a respective side plate piece integral with and extending from each said of side first, second, third and fourth plates at respective transverse fold lines along which said blank is folded for forming said case, said transverse fold lines extending substantially perpendicular to said parallel longitudinal fold lines, said side plate pieces corresponding to a pair of opposed side walls of said case when said blank is folded for forming said case, said second plate having engaging hole means extending therethrough at each of said transverse fold lines extending at each side of said second plate; and a pair of shaping plates provided in said first plate, said shaping plates defined by a pair of spaced apart longitudinal cut lines in said first plate extending parallel to said longitudinal fold lines and the ends of which are spaced respectively from the transverse fold lines extending along each side of said first plate, a central cut line in said first plate extending between said pair of longitudinal fold lines at a central portion of said first plate, a respective engaging tab means extending towards each side of said first plate at said central portion and defined by said central cut line, a first pair of transverse fold lines each of which extends perpendicular to and between a respective pair of ends of said spaced longitudinal cut lines, and a second pair of transverse fold lines each of which is spaced from a respective one of said first pair of transverse fold lines toward said central portion of said upper plate, each of said pair of shaping plates being foldable about respective ones of said first and second pairs of transverse fold lines and being removable from said first plate along said cut lines such that portions of each of said shaping plates defined between said respective ones of said first and second pairs of transverse fold lines abut against said first plate corresponding to said upper wall between said pairs of first transverse fold lines and said transverse fold lines extending along each side of said upper wall for reinforcing said upper wall, and portions of each of said shaping plates defined between respective ones of said pair of second transverse fold lines and said central cut line respectively extend along the surface of a respective one of said pair of opposed side walls for reinforcing said side walls, and said engaging tab means engage said receiving hole means of said second plate corresponding to said bottom wall respectively.

2. A foldable case blank as claimed in claim 1 and further comprising, tongued pieces in said first plate along each of the transverse fold lines extending along the respective sides of said first plate and which project upwardly when said side plate pieces attached to both sides of said first plate are folded along both of the respective transverse fold lines, said tongued pieces being located such that tongued pieces of one case engage said engaging hole means of the bottom wall of another case when stacked on the former mentioned case.

3. A foldable case blank as claimed in claim 1 wherein, each of said second pair of transverse fold lines is spaced from a respective one of said first pair of transverse fold lines toward said central portion of said upper plate at a distance equal to that of said spacing between the respective ends of said longitudinal cut lines and said transverse fold lines extending along each side of said first plate.

4. A foldable case blank as claimed in claim 1 wherein, said portions of each of said shaping plates defined between said respective ones of said first and second pairs of transverse fold lines abut against the surface of said first plate corresponding to said upper wall which is in the inside of the formed case between said pair of first transverse fold lines and said transverse fold lines extending along each side of said upper wall, and said portions of each of said shaping plate defined between respective ones of said pair of second transverse fold lines and said central cut line respectively extend along the surface of a respective one of said pair of opposed side walls which is in the inside of the formed case for reinforcing said side walls.

* * * * *